US007703616B2

(12) United States Patent
Rafailovic et al.

(10) Patent No.: US 7,703,616 B2
(45) Date of Patent: Apr. 27, 2010

(54) TELESCOPABLE SLIDING BEAM

(75) Inventors: Mikica Rafailovic, Ehingen (DE); Alexander Patte, Allmendingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 233 days.

(21) Appl. No.: 11/494,264

(22) Filed: Jul. 26, 2006

(65) Prior Publication Data

US 2007/0175850 A1 Aug. 2, 2007

(30) Foreign Application Priority Data

Aug. 1, 2005 (DE) ..... 20 2005 012 049 U

(51) Int. Cl.
*B66C 23/04* (2006.01)

(52) U.S. Cl. ..... 212/289; 212/349

(58) Field of Classification Search ..... 212/288, 212/289, 349

See application file for complete search history.

(56) References Cited

U.S. PATENT DOCUMENTS

| | | | | | |
|---|---|---|---|---|---|
| 3,300,060 | A | * | 1/1967 | Lado | 212/289 |
| 3,871,265 | A | * | 3/1975 | Koga et al. | 91/189 R |
| 4,589,076 | A | | 5/1986 | Fujioka | |
| 4,593,791 | A | | 6/1986 | Matthews | |
| 5,355,769 | A | * | 10/1994 | Kottke | 91/184 |
| 5,638,616 | A | * | 6/1997 | Kishi | 37/186 |
| 5,927,520 | A | * | 7/1999 | Barthalow et al. | 212/289 |
| 6,813,988 | B2 | * | 11/2004 | Kruppa et al. | 91/189 R |

FOREIGN PATENT DOCUMENTS

| | | | | |
|---|---|---|---|---|
| DE | 1 781 409 | | | 1/1972 |
| DE | 100 691 | | | 10/1973 |
| DE | 101 878 | | | 11/1973 |
| DE | 2 260 815 | | | 6/1974 |
| DE | 2260815 | | | 6/1974 |
| DE | 24 48 608 | | | 4/1976 |
| DE | EP 0 126 634 | | | 11/1984 |
| DE | 40 21 280 | A | * | 2/1992 |
| DE | EP 0 566 720 | | | 10/1993 |
| DE | 94 20 465.9 | | | 2/1995 |
| DE | EP 0 743 275 | | | 12/1996 |
| DE | EP 0 749 935 | | | 12/1996 |
| EP | 0947710 | | | 10/1999 |
| GB | 1 380 371 | A | * | 1/1975 |
| WO | WO 93/008116 | | | 4/1993 |

* cited by examiner

*Primary Examiner*—Thomas J. Brahan
(74) *Attorney, Agent, or Firm*—Alleman Hall McCoy Russell & Tuttle LLP

(57) ABSTRACT

The present disclosure relates to a telescopable sliding beam comprising a sliding beam box and at least one first and one second sliding beam, which are telescopable into each other, the first sliding beam being mounted in the sliding beam box such that it can be telescoped out, where at first the first sliding beam can be telescoped out, and after the same has telescoped out to a desired point, the second sliding beam can be telescoped out, whereas during backward retraction, the second sliding beam can first be retracted to a desired point and subsequently the first sliding beam can be retracted.

14 Claims, 3 Drawing Sheets

PRIOR ART

TELESCOPABLE SLIDING BEAM

CROSS-REFERENCE RELATED APPLICATION

This application claims priority to German Utility Model Application Serial No. 20 2005 012 049.9 filed Aug. 1, 2005, which is hereby incorporated by reference in its entirety for all purposes.

FIELD

The present disclosure relates to a telescopable sliding beam as it is generally applicable in work machines, preferably in truck cranes or excavators.

BACKGROUND AND SUMMARY

Especially in the field of truck cranes or also excavators there is a multitude of possibilities for hydraulic support, which serve to improve the load bearing capacity and the stability. Simple telescopable sliding beams, dual telescopable sliding beams, collapsible beams or also combinations of collabsible beams and sliding beams are known here, for instance.

Depending on the local conditions and in dependence on the required load bearing capacity, different conditions of extension of the sliding beams laterally extending from the chassis are required for a safe operation, wherein the load input into the sliding beams must be effected via defined load input points for static reasons. In all conditions of extension, it must be possible to reproducibly approach the load input points at any time.

It is already known to provide dual telescopable sliding beams, wherein the systems can be designed differently for telescoping out and retracting the sliding beams. In this case, the provided hydraulic cylinders and rope discharge systems can for instance be combined with each other. Instead of these systems, hydraulic cylinders with chain discharge have already been used. An alternative consists in using two hydraulic cylinders, one for each sliding beam, or to use a single two-stage cylinder.

In the known discharge system with one hydraulic cylinder and one rope or chain discharge, the telescoping operation of the sliding beams is effected as follows:

First of all, the first sliding beam is pushed out by means of a hydraulic cylinder between sliding beam box and sliding beam. The discharge of the second sliding beam is effected synchronously, as the same is mechanically connected with the first sliding beam via a hoist system comprising ropes or chains. In principle, the mechanical connection of the two sliding beams and the fixed length of the ropes or chains provides for a defined, always reproducible telescoping of the sliding beams up to the respective load input points of all conditions of extension.

In a discharge system with two hydraulic cylinders or one two-stage cylinder, the telescoping operation of the sliding beams is effected as follows:

Reference can be made to FIG. 1, which illustrates the basic structure of a corresponding telescopable sliding beam in accordance with the prior art. A sliding beam box 10 accommodates a first sliding beam 12 and a second sliding beam 14. Sliding beam box, first sliding beam and second sliding beam are each connected with each other via two hydraulic cylinders 16 and 18 to be pressurized with hydraulic pressure at the same time or via one two-stage hydraulic cylinder which is not shown here in FIG. 1 or FIG. 2. When the cylinders are pressurized with hydraulic pressure, the sliding beam with the lowest mechanical resistance will start to move first. While telescoping, the resistance in the bearing of the moving sliding beam will be increased. When the mechanical resistance of the moving sliding beam exceeds that of the still stationary sliding beam, the same will stop, and the sliding beam stationary so far will start to move. During a telescoping operation, this change of movement between the two sliding beams is repeatedly performed arbitrarily. Due to the changing mechanical resistances in the bearing of the sliding beam and the accordingly load-dependent telescoping of the sliding beams, a defined telescoping of the sliding beams up to the respective load input points cannot be effected under conditions of reduced extension.

Therefore, it is the object underlying the present disclosure to develop a generic telescopable sliding beam such that it can be telescoped out and retracted reproducibly, wherein in particular predetermined load input points can selectively be approached under conditions of reduced extension.

In accordance with the present disclosure, this object is solved by a telescopable sliding beam with a sliding beam box and at least one first and one second sliding beam, which are telescopable into each other, the first sliding beam being mounted in the sliding beam box such that it can be telescoped out. In accordance with the present disclosure, the first sliding beam can first be telescoped out to a desired point and then the second sliding beam can be telescoped out, whereas during the backward retraction, the second sliding beam can first be retracted to a desired point, and only then can the first sliding beam be retracted. The solution of the present disclosure is not restricted to two sliding beams. According to this solution principle, more than two sliding beams might form the telescopable sliding beam.

Accordingly, hydraulic cylinders are provided for telescoping out or retracting the sliding beams.

Particularly advantageously, a pressure sequence control is provided for the hydraulic cylinders. By means of the same, the first sliding beam in the first hydraulic cylinder is first extended in a controlled way, whereupon the second sliding beam is extended via a second hydraulic cylinder. During retraction, the second sliding beam is first retracted in a controlled way via the second hydraulic cylinder, whereupon the first sliding beam is retracted via the first hydraulic cylinder.

Advantageously, the pressure sequence control can be implemented by corresponding valves provided in the hydraulic conduits used for supplying the hydraulic cylinders.

Particularly advantageously, the telescopable sliding beams can be used in work machines, preferably truck cranes and excavators. Therefore, the present disclosure also relates to corresponding work machines 100 (see FIG. 3), preferably truck cranes and excavators, comprising at least one, but advantageously four corresponding telescopable sliding beams.

BRIEF DESCRIPTION OF THE FIGURES

Further features, details and advantages of the present disclosure can be taken from the embodiments illustrated in the drawings, in which.

DETAILED DESCRIPTION

Figure 1:
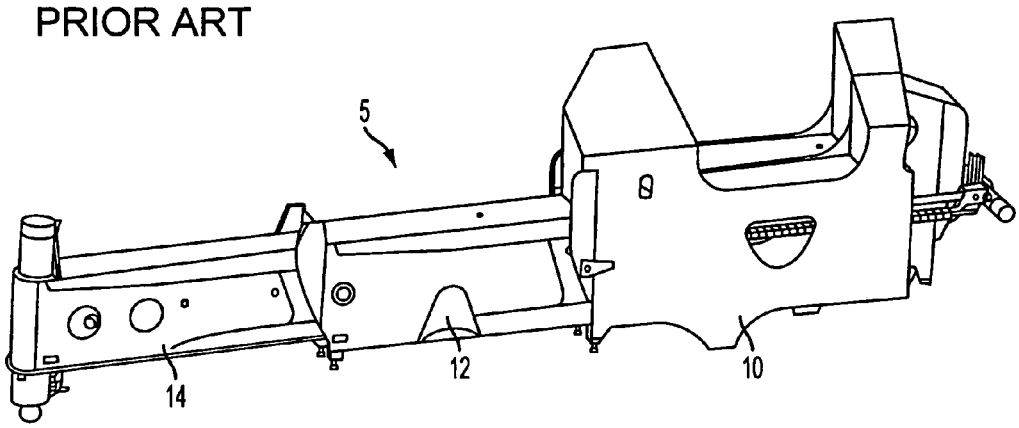
FIG. 1 PRIOR ART
FIG. 1 shows a perspective view of a telescopable sliding beam in accordance with the prior art.
Figure 2:
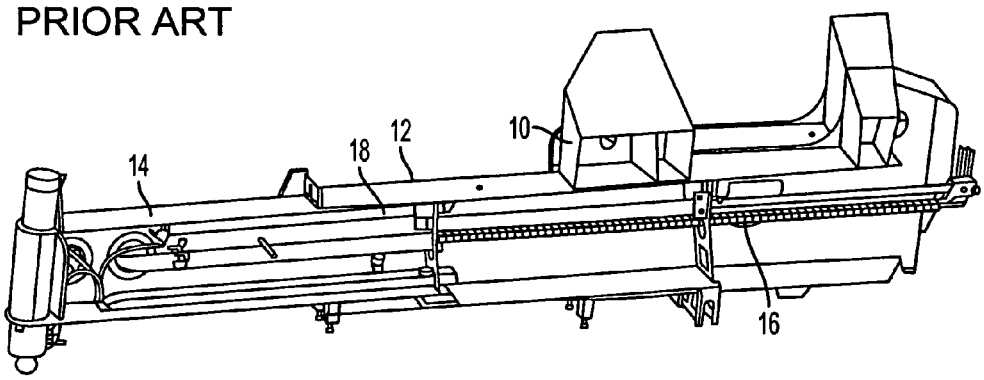
FIG. 2 shows a view in accordance with FIG. 1, but as a section.

FIGS. 1 and 2 show the basic structure of a telescopable sliding beam 5, as it has already been known from the prior art. The telescopable sliding beam 5 substantially consists of a sliding beam box 10 firmly connected with the chassis of a non-illustrated truck crane, which sliding beam box accommodates a first sliding beam 12 movable in longitudinal direction, which is connected with the sliding beam box via the first hydraulic cylinder 16. A second sliding beam 14 is mounted in the sliding beam 12 so as to be movable in longitudinal direction and is connected with the sliding beam 12 via a second hydraulic cylinder 18.

In accordance with the present disclosure, the oil connections of the hydraulic cylinders are connected with each other via a pressure sequence control, which is either integrated in the hydraulic cylinders (not shown in FIGS. 1 and 2) or is configured externally in a separate control block (also not shown in FIGS. 1 and 2). Therefore, the sequence in which the hydraulic cylinders can be extended and retracted is freely selectable by corresponding constructive measures and by the assignment of the corresponding oil connections.

Figure 3:
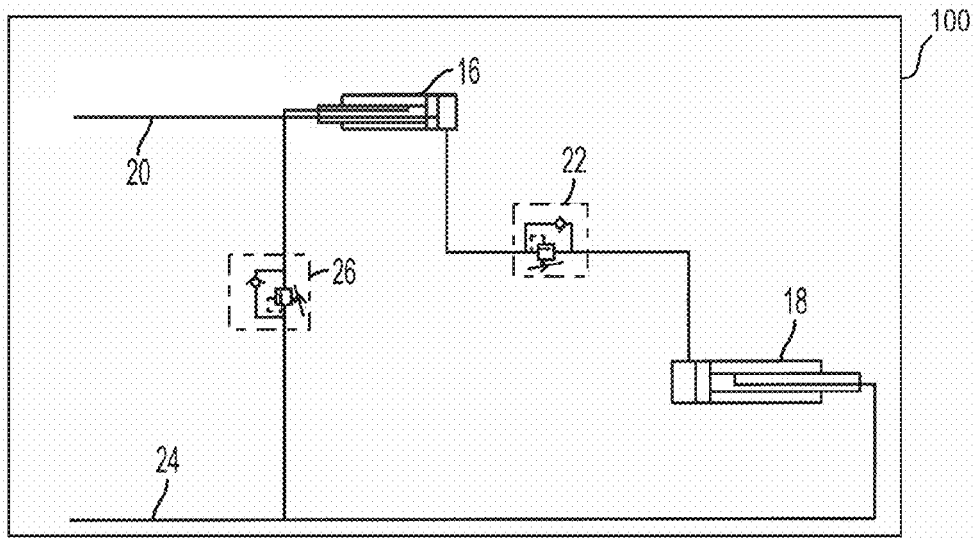
FIG. 3 shows a hydraulic circuit by means of which a pressure sequence control is implemented.
Figure 4:
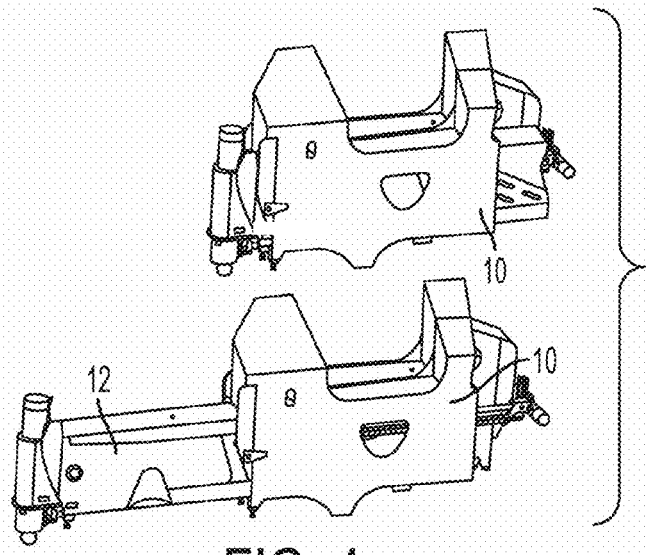
FIGS. 4-7 show telescopable sliding beams of the present disclosure in different conditions of extension.

A pressure sequence control, which provides for a movement of telescoping out or retracting in accordance with the present disclosure, is illustrated in FIG. 3 by way of example. The cylinders 16 and 18 are schematically illustrated in this Figure. Via a first oil conduit 20, via which the hydraulic pressure for extending the telescopable sliding beam is provided, the hydraulic cylinder 16 is first extended up to a desired condition of extension. During this time, a hydraulic valve 22, which is arranged between the first hydraulic cylinder 16 and the second hydraulic cylinder 18, is closed. This effects a controlled extension of the first hydraulic cylinder 16 and hence of the sliding beam 12. Together with the sliding beam 12, the sliding beam 14 disposed within the same is of course moved out of the sliding beam box 10. The relative movement between the sliding beam 12 and the sliding beam 14 is zero in this condition of extension, as the connection to the hydraulic cylinder 18 is blocked by the valve 22. This movement of extension is illustrated in FIG. 4, which shows the retracted position of the telescopable sliding beam as well as the extended position of the sliding beam 12.

Figure 5:
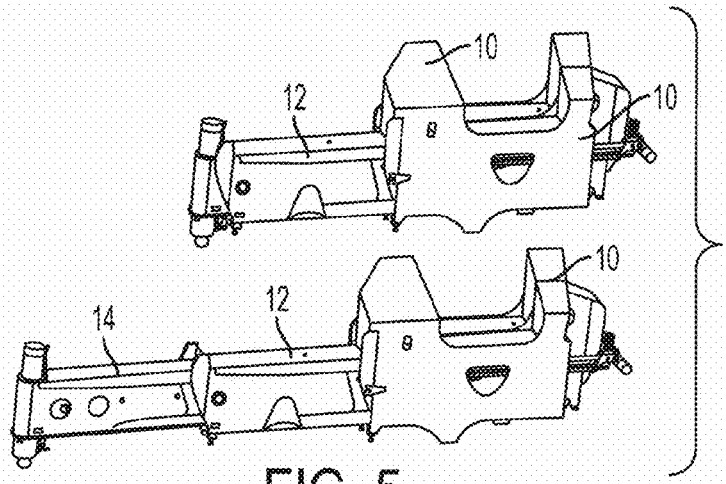

As soon as the hydraulic cylinder 16 has reached its terminal position, the hydraulic system pressure will increase. If a limit pressure preset at the valve 22 is reached, this valve will open. The hydraulic cylinder 18 then is supplied with hydraulic oil and extends. As a result, the sliding beam 14 is moved out of the sliding beam 12. The relative movement between sliding beam 12 and sliding beam box 10 now is zero, as the hydraulic cylinder 16 already is fully extended. This situation is illustrated in FIG. 5, where the upper view shows the starting position before the second sliding beam 14 telescopes out, and the lower view then shows the situation with the sliding beam 14 completely extended.

During retraction, the hydraulic cylinder 18 now is first pressurized via the hydraulic conduit 24, the connection to the cylinder 16 being blocked by a valve 26 (cf. FIG. 3).

Figure 6:
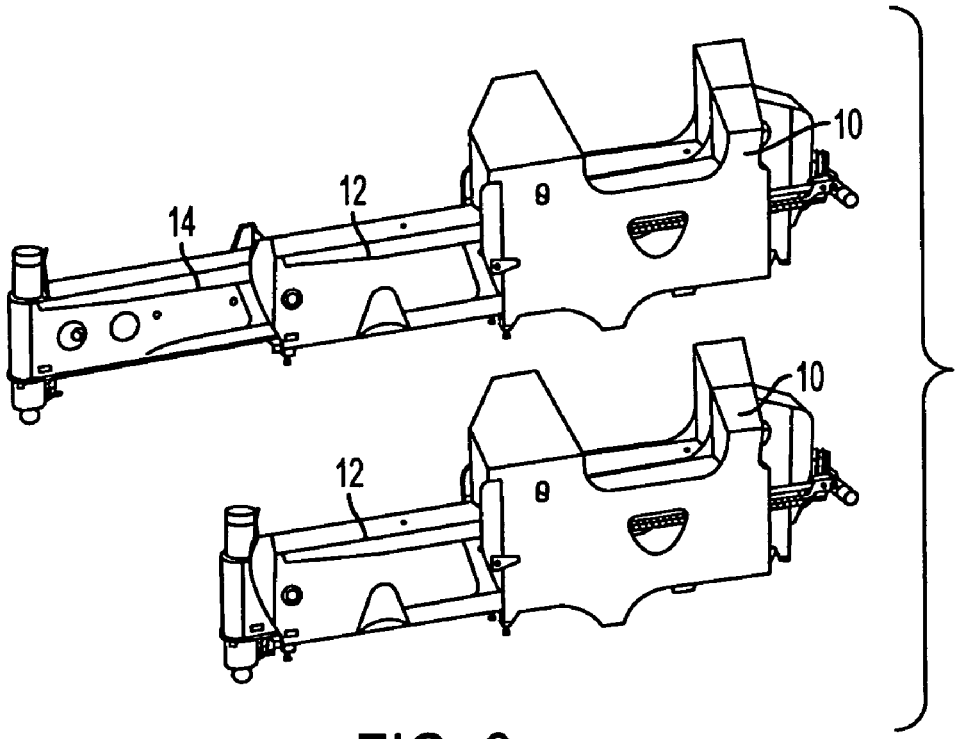
Figure 7:
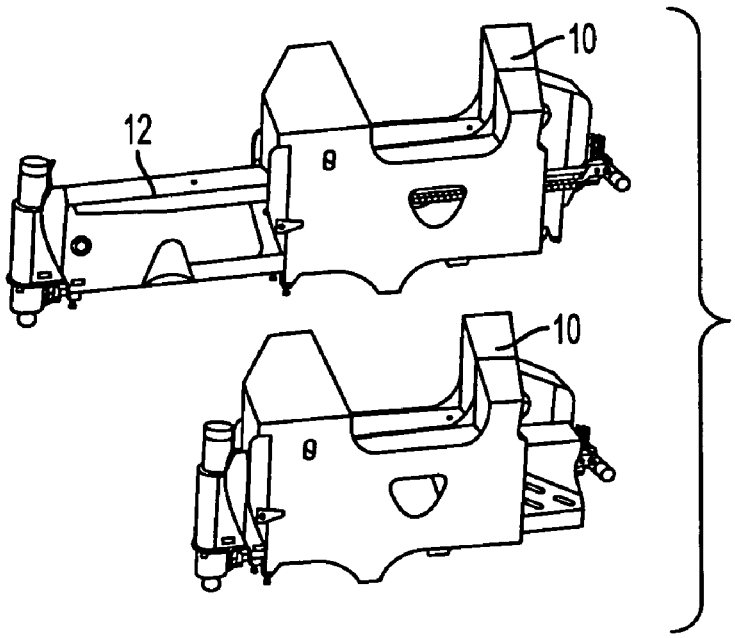

The cylinder 18 retracts, and the sliding beam 14 is retracted into the sliding beam 12, as can easily be taken from a comparison of the upper and lower views of FIG. 6. The relative movement between the sliding beam 12 and the sliding beam box 10 is zero, as the connection to the hydraulic cylinder 16 still is blocked by the valve 26.

Subsequently, a controlled retraction of the hydraulic cylinder 16 is effected, the sliding beams 12 and 14 being retracted into the sliding beam box 10. This is achieved in that the hydraulic system pressure increases upon reaching the terminal position of the hydraulic cylinder 18. When a pressure preset at the valve 26 is reached, this valve will open. Thereupon, the cylinder 16 is supplied with oil and retracts. By means of this movement of retraction of the hydraulic cylinder, the sliding beam 12 is drawn into the sliding beam box 10 together with the sliding beam 14. The relative movement between the sliding beam 12 and the sliding beam 14 is zero, as the cylinder 18 already is fully retracted.

The invention claimed is:

1. A telescopable sliding beam comprising:

a sliding beam box;

at least one first sliding beam and one second sliding beam, where one of the first sliding beam and the second sliding beam telescopes into the other of the first sliding beam and the second sliding beam, the first sliding beam being mounted in the sliding beam box such that it can be telescoped out, the beams adapted to telescope out by first telescoping out the first sliding beam, and when the first beam has telescoped out to a desired point, telescoping out the second sliding beam, the beams being further adapted to retract backward by first retracting the second sliding beam to a desired point, and then subsequently retracting the first sliding beam;

a first hydraulic cylinder connecting the first sliding beam to the sliding beam box, the first hydraulic cylinder having a barrel with a cap-ended extension chamber on a first side of a piston and a rod-ended retraction chamber on a second opposing side of the piston;

a second hydraulic cylinder connecting the second sliding beam to the first sliding beam, the second sliding beam mounted in the first sliding beam, the second hydraulic cylinder having a barrel with an cap-ended extension chamber on a first side of a piston and a rod-ended retraction chamber on a second opposing side of the piston; and a pressure sequence control system where the first sliding beam and the second sliding beam telescope out in sequence upon reaching a pressure preset, wherein the pressure sequence control is implemented by hydraulic valves, and wherein one of the hydraulic valves will open when a limit pressure preset at said one of the hydraulic valves is reached, the pressure sequence control system including:

a first oil supply conduit coupled to the extension chamber of the first hydraulic cylinder, an extension conduit coupling the extension chamber of the first hydraulic cylinder with the extension chamber of the second hydraulic cylinder, a first hydraulic valve being a sequence valve arranged between the extension chamber of the first hydraulic cylinder and the extension chamber of the second hydraulic cylinder, disposed within the extension conduit, a second oil supply conduit coupled to the retraction chamber of the second hydraulic cylinder, a retraction conduit, coupling the retraction chamber of the second hydraulic cylinder with the extension chamber of the first hydraulic cylinder, and a second hydraulic valve being a sequence valve arranged between the retraction chamber of the second hydraulic cylinder and the retraction chamber of the first hydraulic cylinder, disposed within the retraction conduit.

2. The telescopable sliding beam as claimed in claim 1, wherein the pressure sequence control system includes a pressure sequence control circuit for the hydraulic cylinders, by which a pressure level in the hydraulic cylinders is sequentially changed, such that the first sliding beam can first be extended in a controlled way via the first hydraulic cylinder, whereas during retraction the second sliding beam can first be retracted in a controlled way via the second hydraulic cylinder, whereupon the first sliding beam can be retracted via the first hydraulic cylinder.

3. A work machine, comprising:

at least one telescopable sliding beam having a sliding beam box; and at least one first sliding beam and one second sliding beam, where one of the first sliding beam and the second sliding beam telescopes into the other of the first sliding beam and the second sliding beam, said first sliding beam being mounted in said sliding beam box such that it can be telescoped out; and a first hydraulic actuator coupled to said first sliding beam and to said sliding beam box, the first hydraulic actuator having a sleeve with an extension chamber on a first side of a piston and a retraction chamber on a second opposing side of the piston;

a second hydraulic actuator coupled to said second sliding beam and to the first sliding beam, the second hydraulic actuator having a sleeve with an extension chamber on a first side of a piston and a retraction chamber on a second opposing side of the piston; and a pressure sequence control system where the first sliding beam and the second sliding beam telescope out in response to a change in pressure, for, during extension, supplying hydraulic fluid to said first hydraulic actuator and blocking the supply to said second actuator; and then supplying hydraulic fluid to said second actuator; and for, during retraction, supplying hydraulic fluid to said second hydraulic actuator and blocking the supply to said first actuator; and then supplying hydraulic fluid to the said actuator, wherein the pressure sequence control is implemented by hydraulic valves, and wherein one of the hydraulic valves will open when a limit pressure preset at said one of the hydraulic valves is reached, the pressure sequence control system including:

a first oil supply conduit coupled to the extension chamber of the first hydraulic actuator, an extension conduit coupling the extension chamber of the first hydraulic cylinder with the extension chamber of the second hydraulic cylinder, a first hydraulic valve being a sequence valve arranged between the extension chamber of the first hydraulic actuator and the extension chamber of the second hydraulic actuator, disposed within the extension conduit, a second oil supply conduit coupled to the retraction chamber of the second hydraulic actuator, a retraction conduit, coupling the retraction chamber of the second hydraulic cylinder with the extension chamber of the first hydraulic cylinder, and a second hydraulic valve being a sequence valve arranged between the retraction chamber of the second hydraulic actuator and the retraction chamber of the first hydraulic actuator, disposed within the retraction conduit.

4. The machine of claim 3, further comprising an extension hydraulic supply line and a retraction hydraulic supply line, wherein said control system includes a first valve coupled between said first actuator and said second actuator, and a second valve coupled between said extension and retraction hydraulic supply lines, wherein said extension hydraulic supply line supplies fluid during extension, and said retraction hydraulic supply line supplies fluid during retraction.

5. The machine of claim 4, wherein said machine is a truck crane.

6. The machine of claim 4, wherein said machine is an excavator.

7. The machine of claim 4, wherein said control system, during extension, supplies hydraulic fluid to said first hydraulic actuator from said extension hydraulic supply line and blocks the supply to said second actuator by closing said first valve.

8. The machine of claim 7, wherein said control system, during extension, supplies hydraulic fluid from said extension hydraulic supply line to said second hydraulic actuator by opening said first valve.

9. The machine of claim 4, wherein said control system, during retraction, supplies hydraulic fluid to said second hydraulic actuator from said retraction hydraulic supply line and blocks the supply to said first actuator by closing said second valve.

10. The machine of claim 7, wherein said control system, during retraction, supplies hydraulic fluid from said retraction hydraulic supply line to said first hydraulic actuator by opening said second valve.

11. A method of operating a telescopable sliding beam, the beam having a sliding beam box and at least one first sliding beam and one second sliding beam, where one of the first sliding beam and the second sliding beam telescopes into the other of the first sliding beam and the second sliding beam, the first sliding beam being mounted in the sliding beam box via a first hydraulic cylinder such that it can be telescoped out, the first and second sliding beams coupled together via a second hydraulic cylinder, each of the hydraulic cylinders having a barrel with a cap-ended extension chamber on a first side of a piston and a rod-ended retraction chamber on a second opposing side of the piston, and a pressure sequence control system where the first sliding beam and the second sliding beam operate in response to a change in pressure level, wherein the pressure sequence control is implemented by first and second hydraulic sequence valves, the first hydraulic valve disposed within an extension conduit, the extension conduit coupled between the extension chamber of the first hydraulic cylinder and the extension chamber of the second hydraulic cylinder, and the second hydraulic valve disposed within a retraction conduit, the retraction conduit coupled between the retraction chamber of the second hydraulic cylinder and the retraction chamber of the first hydraulic cylinder, comprising:

during extension, telescoping out the first sliding beam from the beam box without telescoping the second sliding beam from the first sliding beam and when the first sliding beam has telescoped out to a desired extension point and upon reaching a first limit preset pressure at the first hydraulic valve, opening the first hydraulic valve and supplying hydraulic oil (pressure) to the extension chamber of the second hydraulic cylinder, thereby telescoping out the second sliding beam;

during backward retraction, retracting the second sliding beam into the first sliding beam without retracting the first sliding beam into the beam box; and when the second sliding beam has been retracted to a desired retraction point and upon reaching a second limit preset pressure at the second hydraulic valve, opening the second hydraulic valve and supplying hydraulic oil (pressure) to the retraction chamber of the first hydraulic valve, thereby retracting the first sliding beam.

12. The method of claim 11, wherein the telescopable sliding beam further includes an extension hydraulic supply, a retraction hydraulic supply, a first actuator coupled to the first beam and a second actuator coupled to the second beam, the method further comprising:

during extension, providing hydraulic fluid from the extension supply to the first actuator and blocking supply to the second actuator until the first beam reaches a desired extension position, and then providing hydraulic fluid from the extension supply to the second actuator until the second beam reaches a desired extension position; and during retraction, providing hydraulic fluid from the retraction supply to the second actuator and blocking supply to the first actuator until the second beam reaches a desired retraction position, and then providing hydraulic fluid from the retraction supply to the first actuator until the first beam reaches a desired retraction position.

13. The method of claim 12, further comprising varying said extension and retraction conditions based on operating conditions.

14. The method of claim 13, wherein said operating conditions include a required load bearing capacity.

* * * * *